United States Patent [19]

Morey et al.

[11] Patent Number: 4,534,390

[45] Date of Patent: Aug. 13, 1985

[54] PORTABLE CHIPPER WITH RELATIVELY LOW POWER HIGH TORQUE TREE FEED MECHANISM FOR FEEDING THE TREE OR OTHER PRODUCT TO BE CHIPPED AT A CONTROLLED FEED ANGLE

[75] Inventors: Norval K. Morey, Winn; Ivor Bateman, Mt. Pleasant, both of Mich.

[73] Assignee: Morbark Industries, Inc., Winn, Mich.

[21] Appl. No.: 549,801

[22] Filed: Nov. 9, 1983

[51] Int. Cl.[3] ..... B27L 11/00

[52] U.S. Cl. ..... 144/373; 144/176; 144/246 B; 144/246 F; 241/56; 241/92; 241/278 A; 241/281

[58] Field of Search ..... 241/92, 56, 278 A, 281; 144/162 R, 176, 242 C, 246 R, 246 E, 246 F, 373, 246 B

[56] References Cited

U.S. PATENT DOCUMENTS 3,332,461 7/1967 Ledergerber ..... 144/176

3,661,333 5/1972 Smith ..... 144/176

4,160,471 7/1979 Lapointe ..... 144/176

*Primary Examiner*—W. D. Bray

*Attorney, Agent, or Firm*—Learman & McCulloch

[57] ABSTRACT

A whole tree feeding and chipping assembly for longitudinally feeding whole trees with attached limbs and branches to a chipper wherein the chipper disc is arranged crosswisely at an acute angle to the longitudinal pathway of feed, and a feed works is provided for feeding the tree butt first to the chipper knives. The feed works includes a generally vertically disposed, fixed axis side feed roll on one side of the pathway, a generally vertically disposed swing side feed roll on the opposite side of the pathway; and a bottom feed roll disposed crosswisely to the pathway and defining the lower boundary of the pathway. A partly conical convergent chute minimizes frictional impedance and a plow is provided for moving debris from the vicinity of the feed works. The rolls are driven at coordinated speeds of rotation in a direction to feed the tree into the chipper mouth.

18 Claims, 5 Drawing Figures

PORTABLE CHIPPER WITH RELATIVELY LOW POWER HIGH TORQUE TREE FEED MECHANISM FOR FEEDING THE TREE OR OTHER PRODUCT TO BE CHIPPED AT A CONTROLLED FEED ANGLE

FIELD OF THE INVENTION

The present invention relates to apparatus for harvesting whole trees with attached limbs and branches, as well as logs and bunches of small trees, parts of trees, branches and brush which are fed by a grapple mounted on a boom on the machine to the chipper feed works.

BACKGROUND OF THE INVENTION

Machinery of the general character to which we refer is illustrated and described in the following patents:

| | | | |
|---|---|---|---|
| 3,244,207 | 3,679,143 | 4,057,192 | 4,160,471 |
| 3,461,931 | 3,955,765 | 4,078,590 | 3,861,602 |

Beginning with the machine described,in the present assignee's prior U.S. Pat. No. 3,661,333, it became possible to reduce entire trees with attached limbs and branches to chips in forest locations. In these tree harvesting operations the machines were moved to various locations in tree plantations or the forest, and chip collecting trucks were loaded at these sites to then haul the chips to the processing plants. Particularly, these forestry operations involved thinning and clean-up of the area surrounding the sites by removing those trees which were ready for harvesting, or were interfering with the growth of trees it was desired to leave to continue their growth, and removing other trees which otherwise would have been left to rot on the forest floor and wasted.

Machines of the prior art were designed to be capable of handling trees with crooked trunks and limbs and bushy, hard-to-handle hardwood trees of a very "limby" nature. The chips from the trees processed had a wide variety of uses and, during the recent energy "crunch", the chips were burned in some localities to provide a valuable energy resource.

The paper industry requires chips of high quality which are within carefully selected size and shape specifications. Chippers which provide chips for the paper industry are arranged at an acute angle of 37½° to the longitudinal pathway of feed, to effect the chipping cut and achieve the chip length desired by the paper manufacturers for their chips.

One of the prime objects of the present invention is to provide a portable chipper feed works which operates with a low power, high feeding torque and feeds the tree butt-first to the anvil along a pathway which ensures that the tree is continually presented to the rotating, knife supporting disc at an angle such that the 37½° relationship is maintained, and chips are cut from the tree at that angle.

Another object of the invention is to provide a feed works which provides for minimum contact of the whole tree with the feed works while still functioning to positively feed the tree at the required angle. With the present design it is contemplated that a lower horsepower, much less expensive engine can be used than is possible with machines of the type disclosed in U.S. Pat. No. 3,661,333.

A further object of the invention is to provide a portable chipper with a feed works which permits the use of a loader which loads the tree on the fly, directly to feed wheels which are located directly adjacent the chipper housing mouth.

Another object of the invention is to provide a machine which eliminates the need for a chain saw operator to saw certain limbs from the tree before processing the tree, the present chipper having a construction such that a heavy limb on the tree can be fed to the chipper mouth in a particular orientation on the "open" side, in which it can be chipped off.

Another object of the invention is to provide a portable chipper with feed works which adapts to the changing diameter of the trunk during the tree chipping operation such that the butt end of the tree is always being presented to the chipper disc at the proper angle, and uniform chips of the required size and shape are produced by the body of the tree as well as by the chipping of the butt end.

Another object of the invention is to provide a bridge between the feed wheels and mouth of the chipper disc which is so shaped and located as to avoid as much frictional contact with the trees being processed as possible, the feed wheels of the assembly operating in conjunction with the bridging chute surface to accomplish this purpose.

Still another object of the invention is to provide a feed works for a portable chipper, wherein a partial chute can be used, which has a partly conical surface and presents as little obstacle to the passage of the tree into the chipper housing opening as possible, this permitting the feed system to operate with as little power as possible because sliding friction is avoided for the most part and the tree is processed instead with principally a rolling frictional contact with the feed works components.

Still another object of the invention is to provide a readily operable plow device for moving collected debris, such as twigs, leaves and small brush from the vicinity of the feed works.

Still a further object of the invention is to provide an economically manufactured and maintained chipper and feed works assembly which can be operated most efficiently and reliably by foresters who are desirous of producing uniformly high quality chips.

SUMMARY OF THE INVENTION

Tree feeding and conditioning mechanism is positioned adjacent a power driven disc chipper to feed trees with attached limbs and branches butt-first into the chipper mouth at a controlled angle. The feed works includes a generally vertically disposed, fixed axis, side feed roll disposed a spaced distance forwardly of the anvil which cooperates with the knives on the chipper disc at one side of the pathway. A swing side feed roll on the opposite side of the pathway is opposite the vertically disposed side feed roll, and a bottom feed roll is disposed crosswisely to the pathway, defining the lower boundary of the pathway. The side feed rolls are rotatable about axes which are disposed in substantially the same vertical transverse plane, and drive mechanism is connected to drive the feed wheels at coordinated speeds of rotation, in a direction to feed material to be reduced to chips into the chipper housing mouth.

Other objects and advantages of the invention will be pointed out specifically or will become apparent from the following description when it is considered in conjunction with the appended claims and the accompanying drawings, wherein:

IN THE DRAWINGS

Figure 1:
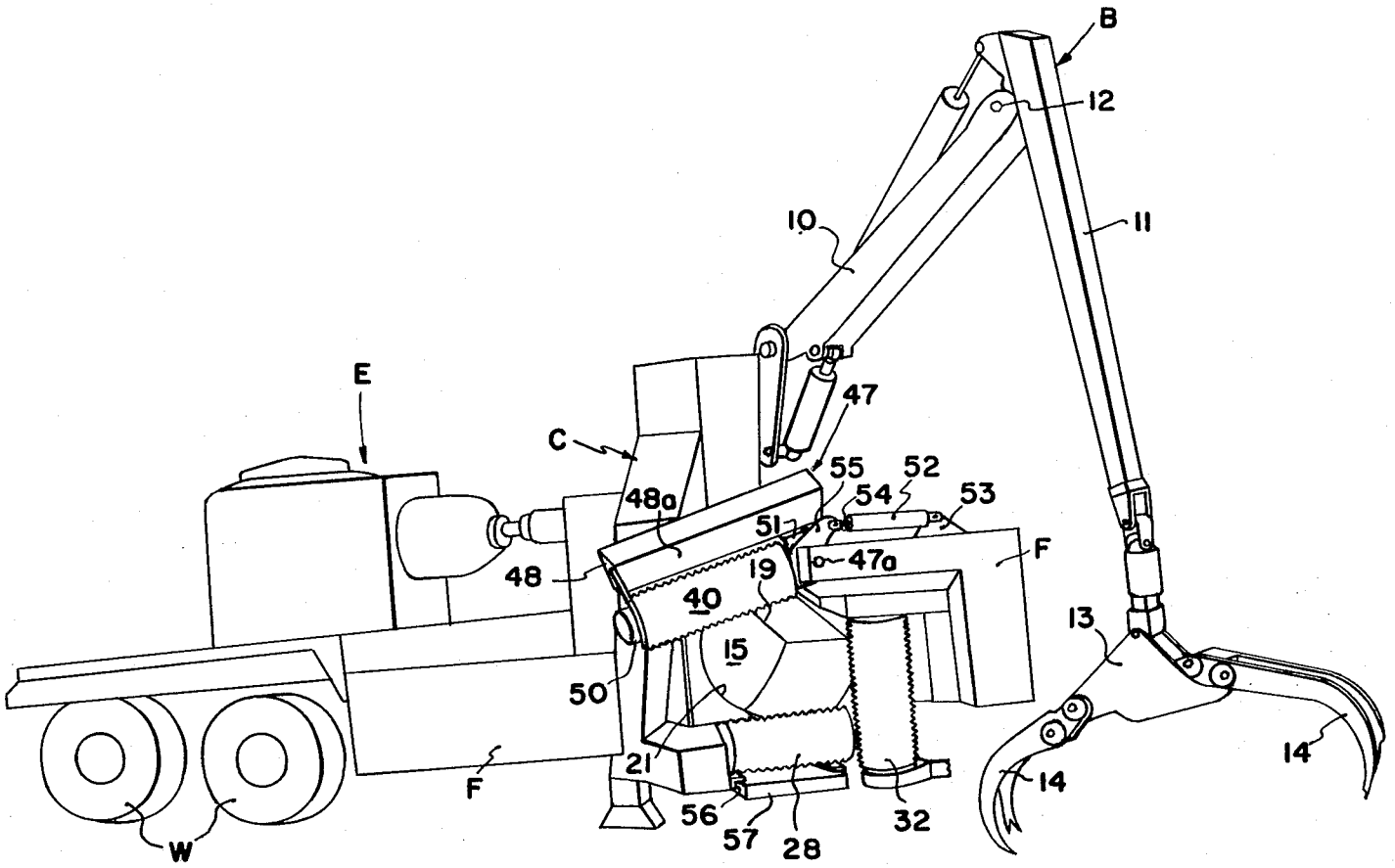
FIG. 1 is a somewhat schematic, elevational view.

Referring more particularly to the accompanying drawings, and in the first instance particularly to FIG. 1, a wheeled vehicle which mounts the machinery is disclosed as having a chassis and frame assembly generally designated F, supported on wheels W. Engine E is mounted on the frame F to drive a disc chipper, generally designated C, which is disposed perpendicularly to the longitudinal axis 1 of the frame F (see also FIG. 3).

As indicated, the present machine is designed to accept and process whole trees with attached limbs and branches, and, in the present instance, trees having trunks of up to thirty inches in diameter, which may be easily fifty or more feet in length.

Also mounted on the frame F is a boom, generally designated B, including a portion 10 mounted to swing about a vertical axis, and a portion 11 mounted to pivot about a horizontal axis 12. Provided on the lower end of the part 11 is a grapple 13 assembly which includes pivotal arms 14 for gripping and releasing a tree. Hydraulic cylinders or the like are provided for operating the grapple arms and the several components of the boom in the usual manner. Generally speaking the tree is loaded butt end first to a novel feed works assembly which now will be described.

It is to be understood that machines of the type described thus far are commonly used in the industry, and are generally described in the patents mentioned heretofore. The present invention is concerned with a novel feed works for feeding the whole trees to the chipper. It is further to be understood that the chipper C is a conventional chipper of the type described in the patents mentioned, and may include a chipper disc 15 mounted on a shaft 16 which is driven in rotation by engine E, via a gear box 17. Chipper knives 18 are provided on the front face of disc 15 in the usual manner adjacent openings 18*a* which lead through the disc to the rear face thereof. Plainly, when the chipper disc 15 is driven in rotation in the counterclockwise direction indicated in FIG. 3 at b, knives 18, in cooperation with an anvil plate 19 which extends into a position of "almost" contact with the knives 18, will chip a tree fed to the chipper disc into chips. The plate 19 is provided with a hardened inner anvil strip or insert 19*a* and extends at an angle of about 60 degrees to the horizontal (see FIG. 2). Fan blades 18*b* on the rear face of disc 15 are provided to deliver the chips to a peripheral discharge spout 15*a* which can direct them in a blown stream to a waiting van or other transport vehicle.

A housing 20 for the disc 15 includes, as usual, a back wall 20*a*, a perimetral wall 20*b* which at its lower end comprises a curvilinear belly-band 20*c*, and a front wall 20*d*. The opening or mouth 21 provided in the front wall 20*d* is illustrated by diagrammatic lines m in FIG. 4, and is bordered or formed along an upper side portion by the inner edge of anvil plate 19. A partial chute surface, generally designated 22, which includes a curvilinear side wall section 22*a*, and a curved bottom wall section 22*b*, adjustably (at 19*b*) supports the anvil plate 19. Lower wall 22*b* has an angular cutout portion 23 which terminates at its left end in FIG. 3 at 23*a*, substantially adjacent the vertical marginal edge 21*a* of opening 21.

Supported from a plate 24 on frame assembly F (see FIG. 2), is a bearing and motor housing 25, the housing 25 accommodating a reversible hydraulic motor 26, coupled as at 27, to a tubular cylindrical roll generally designated 28, having a plurality of radially extending, axially parallel fins 29, with sawtooth-shaped outer edges 29*a*, welded to it at circumferentially spaced apart intervals. The roll 28 includes an internal support 30 for a fixed shaft 31, which drives roll 28 via coupling 27 and motor 26 in rotation about a fixed horizontal axis c. Roll 28, it will be observed, is disposed supported for rotation within the cutout portion 23 (see FIG. 3) provided in the floor 22*b* of the partial chute 22.

Just forwardly (see FIG. 3) of chute side wall portion 22*a*, is a fixed axis side feed roll generally designated 32, which includes a tubular cylindrical roll 33, with similar fins 34 at circumferentially spaced intervals, fins 34 similarly being provided with sawtooth edges 34*a*. The radially outer extremity of fins 34 aligns with anvil edge 19*a* along direction of feed a. A fixed shaft 35, extending through roll 32 is journaled at one end by a frame supported bearing 36 and at its opposite end is connected by a coupling 37 to reversible hydraulic motor 38. The roller 33 rotates about a fixed vertical axis d, which is disposed a substantial distance rearwardly of axis c.

Mounted in line with roller 32 is a tubular, cylindrical swing side roll, generally designated 40, to which a plurality of circumferentially spaced fins 42, having sawtooth edges at 42*a*, are welded. Roll housing 40 has end plates 43 to which a fixed shaft 44 is welded, shaft 44 being rotatable about the axis e of shaft 44 which lies in the same vertical plane f as axis d, the plane f being at right angles to the longitudinal path of feed a. The reversible hydraulic motor 45 is coupled as at 46 to drive shaft 44, and thereby roller 40, in rotation about axis e.

Figure 2:
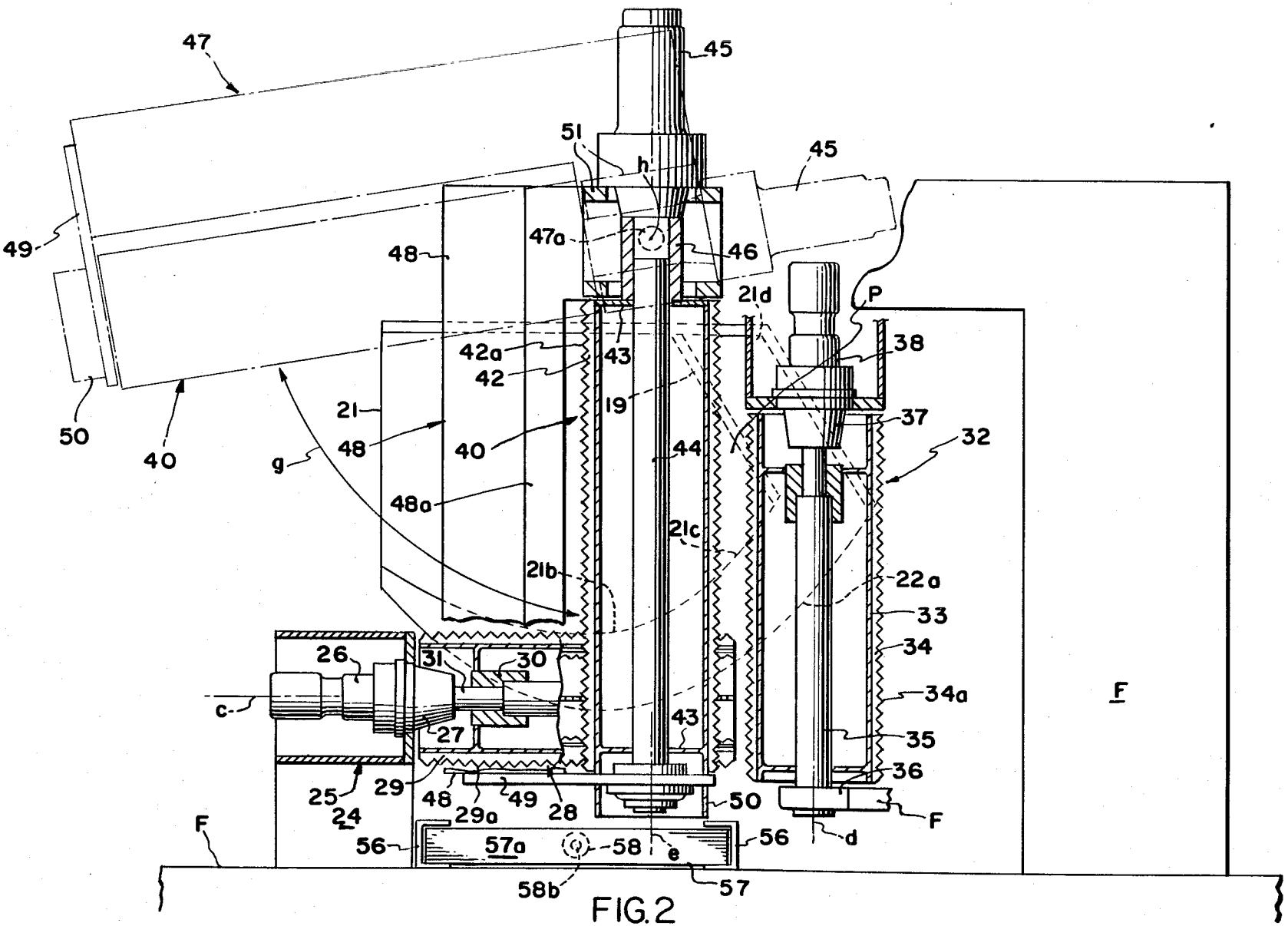
FIG. 2 is an enlarged, front elevational somewhat schematic view of the feed works portion of the machine with the swing side feed roll swung down to lowermost position, the chain lines indicating the maximum upswung position of the roll.

Mounting roller 40 for swinging movement in the plane f from the solid line position shown in FIG. 2 to the raised position shown in chain lines at 40', is a frame, generally designated 47, which comprises a tubular generally rectilinear housing 48 having a deflecting wall 48*a*, which is inclined such as to be convergent with respect to the path of feed a. The shaft 44 is supported for rotation by a plate 49 (which extends from the lower end of housing 47 and mounts a shaft journaling bearing 50) and a bearing housing 51, fixed to the upper end of housing 47, which supports hydraulic motor 45.

Provided to swing the housing 47 and roll 40 in the arc g (FIG. 2) about a horizontal axis h is a hydraulic cylinder 52 (FIG. 1), mounted on frame F at 53. Cylinder 52 has its piston rod 54 pivotally connected to a plate 55 extending from and fixed to housing 47. The housing 47 is mounted to pivot about a pin 47*a*, which is supported by the frame F.

Figure 3:
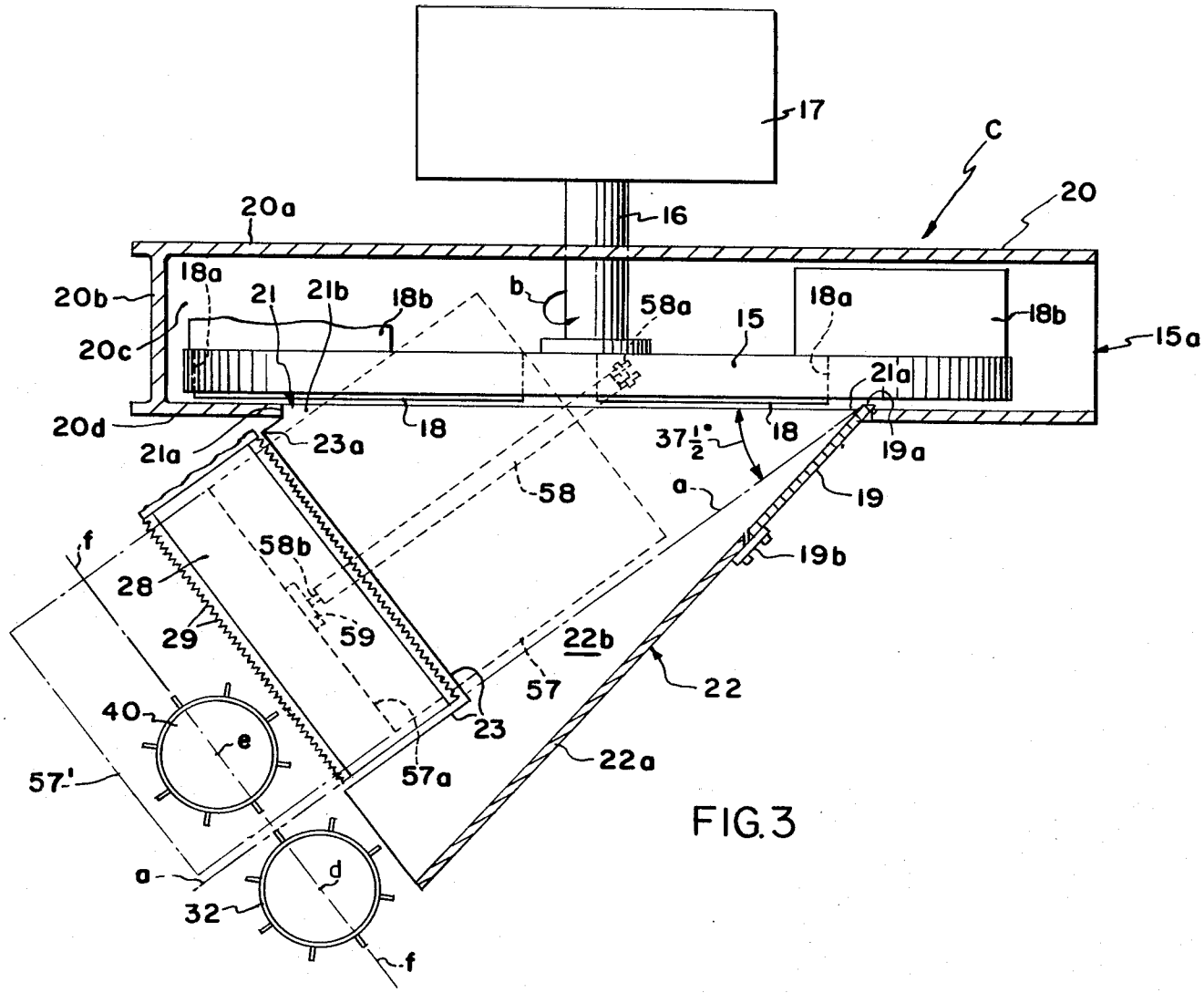
FIG. 3 is a somewhat schematic top plan view, also showing the swing roll in its lowermost position.

It will be observed that the roll 40, as is the case with roll 32, extends downwardly in FIG. 2 sufficiently for its fins 42 to terminate on a level with the bottom of roll 28. Mounted below the level of roll 28, to extend parallel with the feed path axis a, are a pair of channel-shaped guide rails 56 which house a plow box 57, and guide it in sliding movement along the feed path a. The extended position of plow box 57 is shown in FIG. 3. A hydraulic cylinder 58, connected with the frame F at 58*a*, has its piston rod 58*b* connected with the plow box 57 via a coupling 59 and is provided to shift the plow box 57 forwardly to a position designated by the chain lines 57′ in FIG. 3. As is indicated, the front wall 57*a* of box 57 is movable from a position aligned substantially with the axis of roller 28, to a forward position in which it pushes debris collecting in this vicinity such as broken-off twigs, branches and the like, forwardly to a position in front of the transverse plane f in which the axis of rolls 40 and 32 lie.

It is important to note that the side wall 22*a* of the partial chute 22, extends upwardly from the upper right-hand end of bottom roll 28 in FIG. 2, laterally outwardly to the outer side of fixed axis roll 32 where it joins to anvil plate 19. The opposite side of chute C has no side wall and is open to the marginal side edge 21*a* of the mouth or opening 21 in the front wall 20*d* of the chipper housing. The bottom wall 22*b* of the chute extends from the level of the axis c of bottom roll 28 in a rearwardly convergent path to the bottom marginal edge 21*b* of mouth 21, which is at the level of the top of roll 28. Side wall 22*a* converges rearwardly to the marginal side edge portion 21*c* of opening 21 and anvil plate 19 extends at an angle to side wall 22*a* such as to form a tree receiving pocket P with it, and defines the upper portion of the right-hand marginal side edge 21*c* of mouth 21. Plate 19 at its upper end extends to the top marginal edge 21*d* of mouth 21.

Whereas, formerly, the tree, with its compressed branches, was jammed into an enveloping forwardly protruding rectilinear chipper spout, which was conventionally provided on the chipper housing, the concept in the present machine is to restrict the passage of the tree as little as possible, and to avoid a wedging effect as much as possible. The construction here avoids sliding friction insofar as possible, and, rather, seeks to engage the tree with only rotating roll members which create nowhere near the frictional resistance to tree passage.

Figure 4:
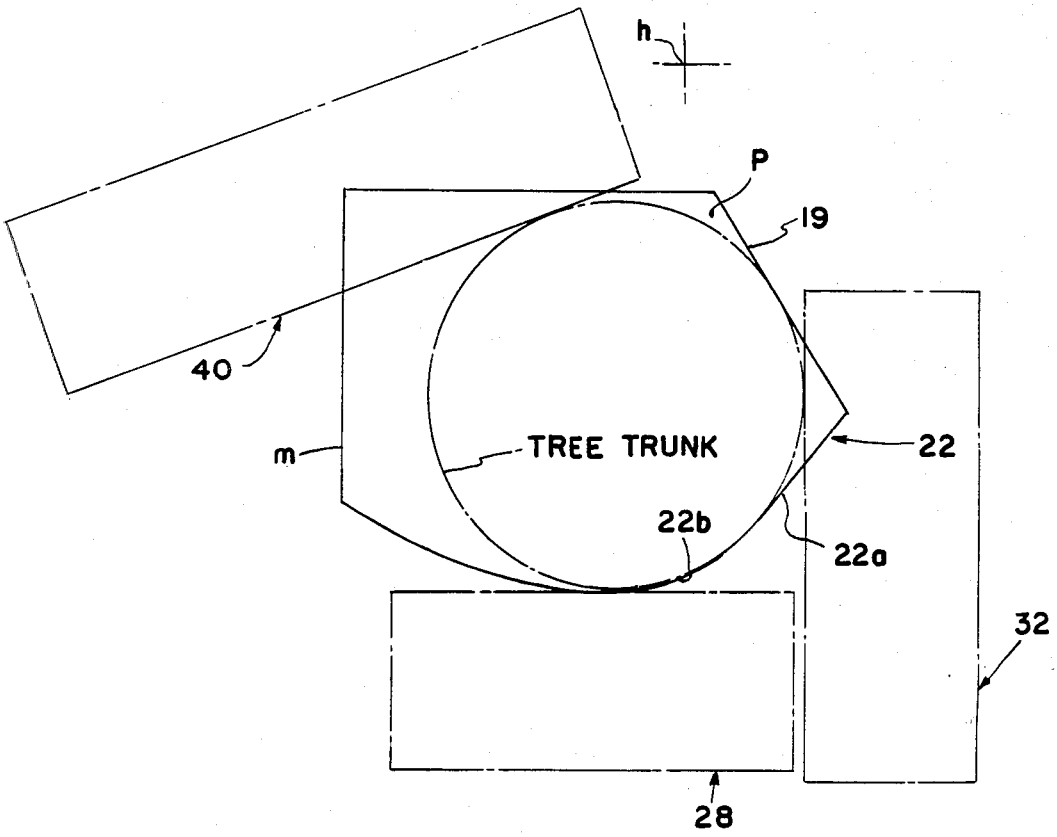
FIG. 4 is a schematic front elevational view.

As indicated in the schematic view, FIG. 4, the position of roller 40 is determined entirely by the diameter of the trunk or material being fed to the chipper. The hydraulic circuit to shortly be described, is arranged to maintain a constant pressure on the hydraulic cylinder 52 which forces the frame 47 and the roll 40 in a downward direction to grip the tree at all times and moves it into entrapped position in generally V-shaped pocket P, the direction of rotation of disc 15 aiding in moving the tree to engage anvil plate 19. The entrapping of the tree is important to ensure that it feeds to the disc 15 at substantially the 37½ degree angle.

Figure 5:
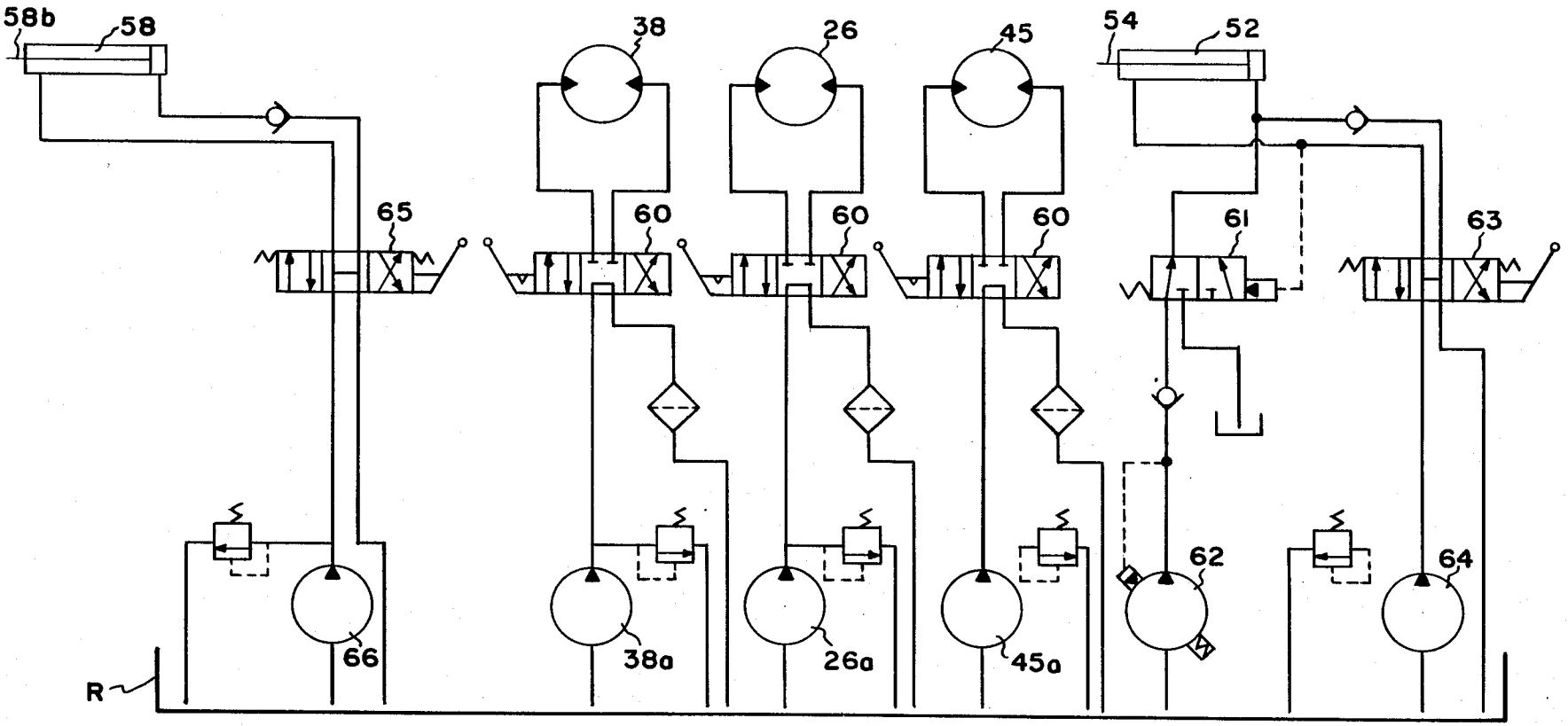
FIG. 5 is a schematic view showing hydraulic components of the system.

In FIG. 5, a schematic hydraulic diagram is shown, wherein the hydraulic motors 38, 26 and 45 are shown as supplied with hydraulic fluid via pumps 38*a*, 26*a*, and 45*a*, from a reservoir R. A manually controlled valve 60 is provided in circuit with each of the pumps and motors and is operative to drive them in one direction or the other, or to, of course, halt the rotation of the motors.

Provided in the hydraulic circuit, to maintain a predesignated pressure in cylinder 52 such as to continually force roll 40 downwardly in the arc g, is a pilot operated control valve 61 connected with a variable volume pump 62. This predesignated pressure can be over-ridden by a manually controlled valve 63, connected with a fixed volume hydraulic pump 64, and with the cylinder 52, to enable the operator to lift the housing 47 and roll 40 upwardly in the arc g to admit a larger tree. Provided between the plow box operating cylinder 58 and a pump 66 for furnishing oil under pressure to either side of the cylinder, while the other side dumps, is a manually controlled valve 65 as shown. Plainly, with manipulation of valve 65, the operator can move the plow box 57 forwardly and rearwardly to accomplish the clearing of debris, when necessary.

THE OPERATION

The operator grips a tree to be reduced to chips with the hydraulically actuated grapple arms 14, and manipulates the knuckle boom B, to bring the end of the tree toward the side feed rolls 32 and 40. These feed rolls 32 and 40, and feed roll 28, are revolved continuously in a direction of rotation to feed the tree toward the chipper mouth 21. It will be noted that all of the rolls are of the same diameter, and it should be understood that they are driven at the same rate of speed. If necessary, the operator will manipulate the valve 63 to override valve 61, and lift the swing wheel 40 sufficiently to provide entrance room for the butt of the tree or trees being gripped by the grapple arms 14. The forward feed of the tree is not halted in this continuous feeding operation and the grapple arms 14 are released "on the fly" so to speak, as the butt end of the tree is fed toward the lower roller 28. Because the axes of rolls 40 and 32 are in the same plane, no force is exerted by roll 40 urging the butt of the tree against anvil edge 19*a* and there is no such force creating frictional drag on the feed rolls.

Normally, the tree being fed will be of such a size that the roll 40 is disposed at approximately a 45° angle with respect to the vertical plane. When the butt end of the tree passes through the opening 21, it is entrapped in pocket P and in contact with the inner edge 19*a* of anvil plate 19. Chute surface 22 essentially is provided to collect material which has broken off, rather than impedes it, because the feed rolls are positioned to essentially block off the chute and prevent the trunk of a tree from contacting the chute surface.

When a large and spreading limb is encountered on the tree near the butt end the operator can feed it so that it is in substantially horizontal position adjacent mouth edge 21*a* and need not have it precut in order to reduce it to chips. Should there be any kind of a jam-up, the operator, with suitable manipulation of the valves 60, can reverse the direction of rotation of motors 26, 38 and 45. The speed of these motors is such, in both forward and reverse, as to be faster than the "draw" of the chipper knives 18 which pulls the tree into the chipper mouth 21.

While one embodiment of the invention has been described in detail, it will be apparent to those skilled in the art that the above described embodiment may be modified. Therefore, the foregoing description is to be considered exemplary rather than limiting, and the true scope of the invention is that defined in the following claims.

We claim:

1. In a feeding and chipping assembly for longitudinally feeding whole trees with attached limbs and branches butt-first, and like chippable material to be reduced to chips, and including: a longitudinally extending portable chipper frame; a chipper disc thereon; a disc housing for the disc fixed on the frame and having a forwardly facing wall surface with an opening therein to admit the material to the disc; generally radially extending knife means mounted on the front face of said chipper disc; means for rotating said disc at chipping speeds; a chute surface leading rearwardly to the opening in said disc housing; an anvil mounting plate, cooperable with said knife means, at one side of said opening; a generally vertically disposed, fixed axis, side feed roll disposed a spaced distance forwardly of the anvil and defining with the anvil one side of a pathway of feed; a swing side feed roll defining the opposite side of said pathway; a bottom feed roll disposed crosswisely to said pathway defining the lower boundary of the pathway; said swing side feed roll being swingable generally about a generally horizontal axis extending generally parallel to said pathway; each of said side feed rolls being rotatable about axes which are disposed in substantially the same transverse plane; and means supported by the frame for driving said feed rolls at coordinated speeds of rotation in a direction to feed material into the opening and on to be chipped by said knife means.

2. The assembly of claim 1 wherein said bottom feed roll is located a spaced distance from, and behind, the side feed rolls at an angle to the plane of the opening in the said wall of the disc housing such that its one end is substantially adjacent the other side of said opening and its opposite end is spaced forwardly from the plane of said opening in the disc housing, the axis of said bottom feed roll lying in a plane substantially parallel to the said transverse plane.

3. The assembly of claim 2 wherein said generally vertically disposed side feed roll extends downwardly to an elevation substantially level with the bottom of said bottom feed roll.

4. The assembly of claim 2 wherein said swingable feed roll, when swung to a generally vertical position adjacent said fixed axis side roll, has a length extending downwardly to a level near the bottom of the bottom feed wheel.

5. The assembly of claim 2 wherein said opening has a marginal top and bottom connecting said sides, the bottom of said opening is at a level generally at the elevation of the upper surface of said bottom roll, the said one side of the opening curves laterally outwardly and upwardly to the anvil mounting plate, and the anvil mounting plate extends upwardly and laterally inwardly to the top of said opening.

6. The assembly of claim 5 wherein said chute surface has a bottom wall extending to bridge the space between the lower feed roll and said one side of the opening extending generally from the level of the axis of said feed roll to the bottom of said opening, the chute surface having no side wall adjacent said other side of said opening and having a transversely outwardly and upwardly extending curved side wall extending generally from the axis of the feed wheel to said anvil mounting plate and from laterally outwardly of the axis of the fixed axis side feed roll, the said curved side wall converging in a rearward direction to said opening.

7. The assembly of claim 6 wherein said anvil mounting plate comprises a linear wall extending at such an angle from the upper end of the said side wall of the chute surface as to form a rearwardly convergent angular pocket to receive a tree trunk and material to be chipped.

8. The assembly of claim 1 wherein a debris removing member is mounted to move in a path below said bottom feed roll to push debris collecting below said roll to a remote location.

9. The assembly of claim 8 wherein said member comprises a plow box mounted for oscillating movement in a generally horizontal path parallel to said pathway of feed at a level just below said bottom feed roll from a rearward position to an extended position in which its front portion is generally forward of the side feed rolls.

10. The assembly of claim 9 in which side tracks on the frame guide said plow box in its path of movement, and motor means is connected with said plow box for effecting its movement under control of the operator.

11. The assembly of claim 1 wherein motor means is connected with said swing feed wheel for effecting its movement away from said generally vertically extending side feed roll under control of the operator.

12. The assembly of claim 10 wherein hydraulic means normally biases said swing feed roll to move in a direction toward the said fixed axis side feed roll.

13. The assembly of claim 10 wherein a deflector member having a surface diverging to the periphery of said swing feed roll from a position laterally outwardly and forwardly thereof supports said swing roll and has vertically spaced mounts at its opposite ends provided with bearings for rotatably mounting the swing feed roll, said deflector member being mounted to pivot about said generally horizontal axis and swing the swing feed roll thereabout.

14. The assembly of claim 12 wherein said motor means comprises a hydraulic cylinder.

15. The assembly of claim 9 wherein said motor means comprises a hydraulic cylinder connected between the frame and rear of the plow box.

16. The method of longitudinally feeding whole trees with attached limbs and branches butt-first, and reducing the tree to chips, with a chipper disc having a disc housing for the disc with a forwardly facing wall surface, the wall surface having an opening therein to admit the material to the disc and the disc having generally radially extending knife means mounted on its front face; there being: a fixed chute surface converging rearwardly to the opening in said disc housing; an anvil mounting plate, cooperable with the knife means to chip, bordering one side of said opening; a generally vertically disposed, fixed axis, side feed roll disposed a spaced distance forwardly of the anvil and defining with the anvil one side of a pathway of feed; a movable side feed roll defining the opposite side of the pathway; a bottom feed roll disposed crosswisely to the pathway defining the lower boundary of the pathway; the movable side feed roll being movable in a transverse plane; said forwardly facing wall surface around said opening having marginal top and bottom edges connected by marginal side edges, the bottom edge margining the opening being at a level generally at the elevation of the upper surface of the bottom feed roll, said chute surface having a bottom wall extending to bridge the space between the bottom feed roll and said bottom edge and extending generally upwardly from a substantial distance below the upper surface of said bottom feed roll to converge to the bottom edge margining said opening, the chute surface also having a transversely outwardly and upwardly extending curved side wall extending from said chute surface bottom wall to converge toward said anvil mounting plate; wherein the method comprises: driving the disc at a tree chipping speed; and driving the feed rolls at coordinated speeds of rotation in a direction to feed the tree into the opening and on to be chipped by said knife means while essentially blocking off the said bottom and side walls of said chute surface with the bottom and fixed axis feed rolls such as to substantially avoid frictional sliding contact of the tree butt with the chute surface.

17. Apparatus for longitudinally feeding whole trees with attached limbs and branches butt-first, and reducing the tree to chips, including: a frame, a chipper disc journaled thereon; a disc housing on the frame with a forwardly facing wall surface, the wall surface having an opening therein to admit the trees to the disc, the disc having generally radially extending knife means mounted on its front face; a chute surface converging rearwardly to the opening in said disc housing; an anvil mounting plate, cooperable with the knife means to chip, fixed at and bordering one side of said opening; a generally vertically disposed, fixed axis, side feed roll disposed spaced distance forwardly of the anvil and defining with the anvil one side of a pathway of feed which extends at an acute angle to the opening and disc; a movable side feed roll defining the opposite side of the pathway; a generally horizontal axis bottom feed roll disposed crosswisely to the pathway having an upper surface defining the lower boundary of the pathway; the movable side feed roll being movable in a transverse plane; said forwardly facing wall surface around said opening having marginal top and bottom edges connected by opposite side edges, the bottom edge being at a level generally at the elevation of the upper surface of the bottom feed roll; said chute surface having a bottom wall extending to bridge the space between the bottom feed roll and said bottom edge and extending generally upwardly from substantially below the level of the upper surface of said bottom feed roll to the bottom edge of said opening, the chute surface also having a transversely outwardly and upwardly, extending curved side wall extending generally from the bottom wall to said anvil mounting plate, and converging in a rearward direction to said opening from behind said fixed axis side feed roll; means for driving the disc at a tree chipping speed; and means for driving the feed rolls at coordinated speeds of rotation in a direction to feed the tree into the opening and on to be chipped by said knife means while said fixed axis side roll and bottom roll essentially block off said bottom and side walls of said chute surface such as to substantially avoid frictional sliding contact of the tree butt with the chute surface.

18. The apparatus of claim 17 in which said chute surface has substantially no side wall on the side opposite said anvil mounting plate and no top wall.

* * * * *